US010514213B2

(12) United States Patent
Winnard

(10) Patent No.: US 10,514,213 B2
(45) Date of Patent: Dec. 24, 2019

(54) ADJUSTABLE TOOL HOLDER

(71) Applicant: Stanley D Winnard, Dallas, TX (US)

(72) Inventor: Stanley D Winnard, Dallas, TX (US)

( * ) Notice: Subject to any disclaimer, the term of this patent is extended or adjusted under 35 U.S.C. 154(b) by 0 days.

(21) Appl. No.: 16/212,480

(22) Filed: Dec. 6, 2018

(65) Prior Publication Data

US 2019/0107340 A1 Apr. 11, 2019

Related U.S. Application Data

(63) Continuation of application No. 15/888,080, filed on Feb. 5, 2018, which is a continuation of application No. 14/983,621, filed on Dec. 30, 2015, now abandoned.

(51) Int. Cl.

| | |
|---|---|
| ***B25H 3/00*** | (2006.01) |
| ***B25H 3/04*** | (2006.01) |
| ***A47F 7/00*** | (2006.01) |
| ***F28F 9/22*** | (2006.01) |
| ***A47B 45/00*** | (2006.01) |
| ***F28F 9/00*** | (2006.01) |

(52) U.S. Cl.

CPC ..... *F28F 9/22* (2013.01); *A47B 45/00* (2013.01); *A47F 7/0028* (2013.01); *B25H 3/04* (2013.01); *F28F 9/001* (2013.01)

(58) Field of Classification Search

CPC ..... B25H 3/04; B25H 3/00; B43K 23/001; B43K 23/00; A47F 7/0028; A47F 7/00

See application file for complete search history.

(56) References Cited

U.S. PATENT DOCUMENTS

| | | | | | |
|---|---|---|---|---|---|
| 517,757 | A * | 4/1894 | Mendenhall | B43K 23/001 | 211/69.8 |
| 642,278 | A * | 1/1900 | Adair | B43K 23/001 | 211/69.8 |
| 1,682,060 | A * | 8/1928 | Banks | A47B 65/00 | 211/42 |
| 2,080,805 | A * | 5/1937 | Brey | A47G 25/746 | 211/120 |
| 2,185,086 | A * | 12/1939 | Janke | A47F 5/0884 | 211/69.8 |
| 2,522,416 | A * | 9/1950 | Weiskopf | G01N 1/312 | 118/503 |
| 5,307,941 | A * | 5/1994 | Siegal | B42F 17/02 | 211/11 |

(Continued)

*Primary Examiner* — Kimberly S Wright
(74) *Attorney, Agent, or Firm* — Peter V. Schroeder

(57) ABSTRACT

Disclosed is an adjustable tool holder for holding elongate hand held tools. The tool holder comprises a telescopically adjustable base member comprising an elongate, rectangular, hollow outer member and an elongate rectangular inner member configured to be snugly and slidably received within the outer member, the inner member adapted to be secured to the outer member at a plurality of lock positions thereby rendering the length of the base member adjustable. The tool holder further comprises a compression spring, one end of which is secured at the free end of the outer member and the other end of which is secured at the free end of the inner member. The length of the spring is subject to change in accordance with the change in the length of the base member. A tool is adapted to be held between two consecutive loops of the spring.

9 Claims, 15 Drawing Sheets

(56) References Cited

U.S. PATENT DOCUMENTS

| | | | | | |
|---|---|---|---|---|---|
| 5,421,466 | A * | 6/1995 | Hsu | A47B 63/00 | 211/120 |
| 5,816,418 | A * | 10/1998 | Hsu | A47F 7/0042 | 211/120 |
| 5,842,583 | A * | 12/1998 | Kasa-Djukic | B25H 3/04 | 211/65 |
| 6,394,400 | B1 * | 5/2002 | Sontag | B65B 67/1222 | 248/97 |
| 7,028,854 | B1 * | 4/2006 | Londrico | A47B 65/00 | 211/120 |
| 7,083,057 | B1 * | 8/2006 | Hatch | B42F 17/02 | 211/11 |
| 7,401,755 | B2 * | 7/2008 | Wu | H05K 5/0204 | 248/222.51 |
| 9,937,615 | B1 * | 4/2018 | Winnard | B25H 3/04 | |
| 2017/0190046 | A1 * | 7/2017 | Winnard | A47B 45/00 | |
| 2018/0154512 | A1 * | 6/2018 | Winnard | A47B 45/00 | |
| 2018/0290292 | A1 * | 10/2018 | Winnard | B25H 3/04 | |

* cited by examiner

ADJUSTABLE TOOL HOLDER

CROSS-REFERENCE TO RELATED APPLICATIONS

This application is a continuation application of U.S. patent application Ser. No. 15/888,088, which itself is a continuation application of U.S. patent application Ser. No. 14/983,621.

FIELD OF THE INVENTION

The present invention relates to tool holders and more particularly to a tool holder that is configured to manually adjustable to suit the dimensions of the tools.

Handheld tools such as kitchen tools and workshop tools, when not in use, are generally hung upon hooks, which, in most cases are coupled to a pegboard. Securing hooks to a pegboard or, in other words, setting up a pegboard is a time-consuming process as, most of the times, the hooks are required to be secured with fasteners, such as, screws, or the like, so that, the hooks they do not come off of it. This—the coming off of the hooks—is caused by the hooks getting stuck with the tools whereby, as the tools are disengaged from the pegboard, the hooks come off with them. Even if the inconvenience of the securing pegs and hooks is ignored for a moment, one needs to pay careful attention while placing especially certain elongate tools to the pegboard as these tools require to be supported by not one, but two or more hooks. Therefore, in a nutshell, placing as well as removing tools from a conventional pegboard or hook systems requires a mental effort on part of the user.

Alternatively, placing the tools on a flat surface, such as, on a table top, etc., is not an ideal solution either. This is because firstly, storage on a horizontal surface expends large space and secondly, placing the tools on a flat surface may lead to a pile up, which may result in the tools falling off ultimately leading to their breakage, etc.

Therefore, in the light of what is discussed and while doing entirely away with the idea of storage on horizontal spaces, there is a need in the art for a solution in the form of a tool holder, which makes it relatively convenient for a tool to be secured thereto. Better yet is such a tool holder that is easily adjustable to accommodate tool of various dimensions.

SUMMARY

The present invention comprises an adjustable tool holder for holding a plurality of elongate hand tools. The tool holder is simple in construction comprises a telescopically-adjustable base member and a compression spring secured to the base member wherein, the length of the spring is automatically and accordingly altered as the length of the base member is manually adjusted. A tool is secured to the tool holder as the tool is received between two consecutive loops of the spring.

More particularly, the base member comprises an elongate, hollow, rectangular outer member that is configured to snugly and slidably receive an elongate, rectangular inner member. Notably, a central longitudinal portion of the outer member is open. While the loop of the spring at one extremity thereof is secured to the free end of the outer member, the loop of the spring at the other extremity thereof is secured to the free end of the inner member whereby, as the length of the base member is manually adjusted, the length of the spring too is automatically and accordingly altered.

The base member further comprises a pair of opposingly-disposed lock assemblies, each of which comprising a plurality of linearly arranged lock holes disposed on a side inner member, a through outer lock hole disposed on a side of the outer member and a lock pin. As the inner member is slid into the outer member, the outer lock hole aligns with the inner lock holes sequentially. When a lock pin is inserted into an inner lock hole via the outer lock hole, the position (i.e., the length) of base member is locked thereat and consecutively so is the length of the spring accordingly.

Other objects and advantages of the embodiments herein will become readily apparent from the following detailed description taken in conjunction with the accompanying drawings.

FIGURES-REFERENCE NUMERALS

Figure 1:
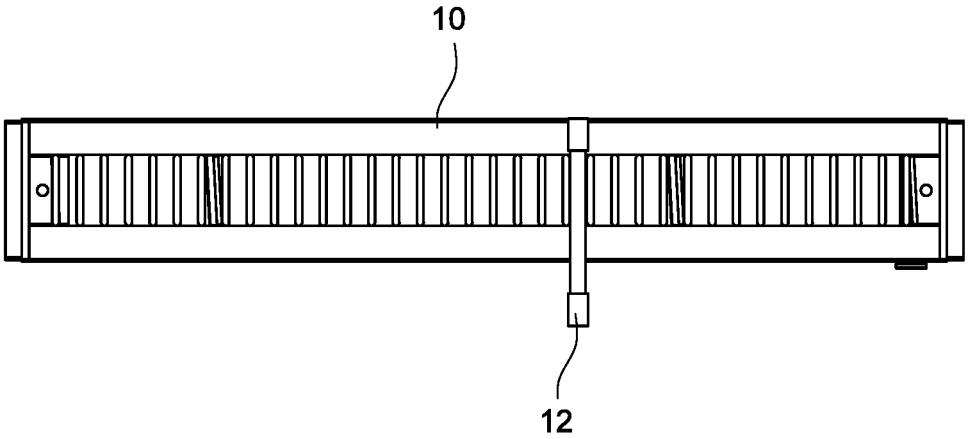
FIG. 1, according to an embodiment of the present invention, is an illustration of the tool holder secured with a tool.
Figure 2:
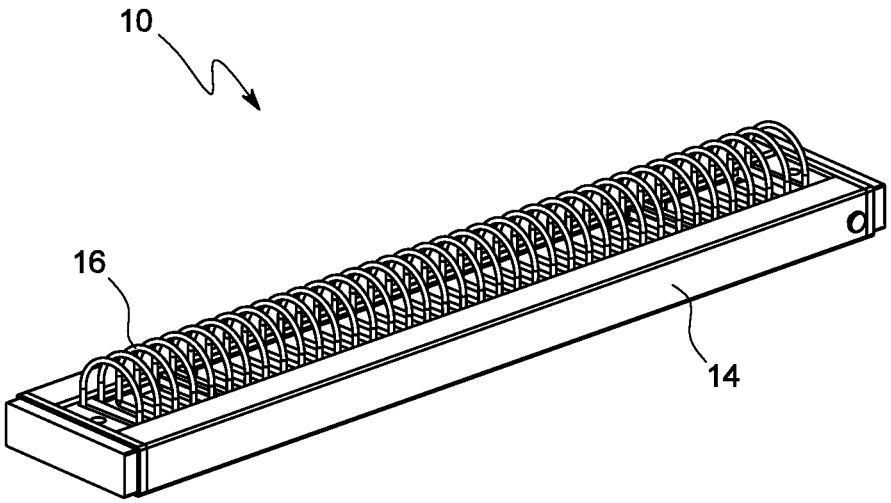
FIG. 2, according to an embodiment of the present invention, is an illustration of a perspective view of the tool holder in the proximal lock position.
Figure 3:
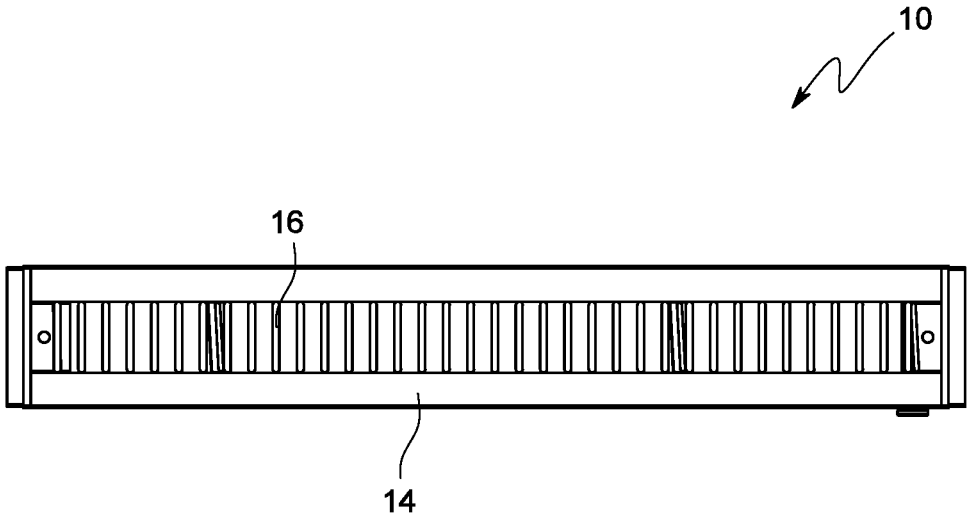
FIG. 3, according to an embodiment of the present invention, is an illustration of the top view of the tool holder in the proximal lock position.
Figure 4:
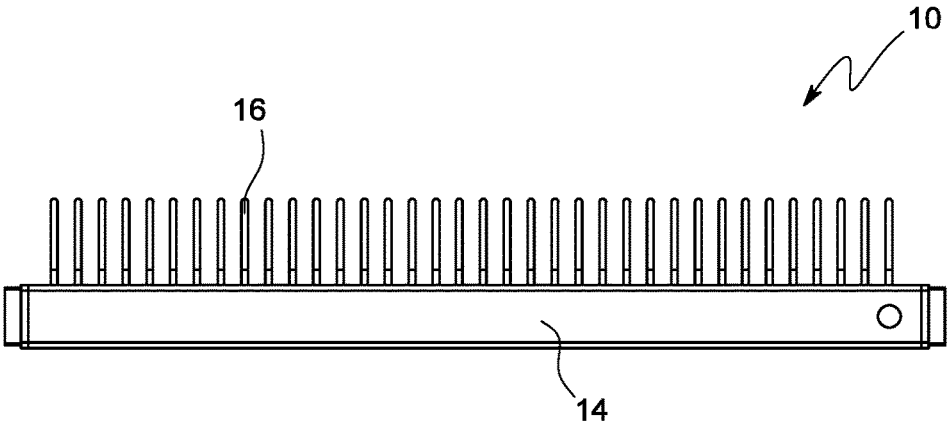
FIG. 4, according to an embodiment of the present invention, is an illustration of a side view of the tool holder in the proximal lock position.
Figure 5:
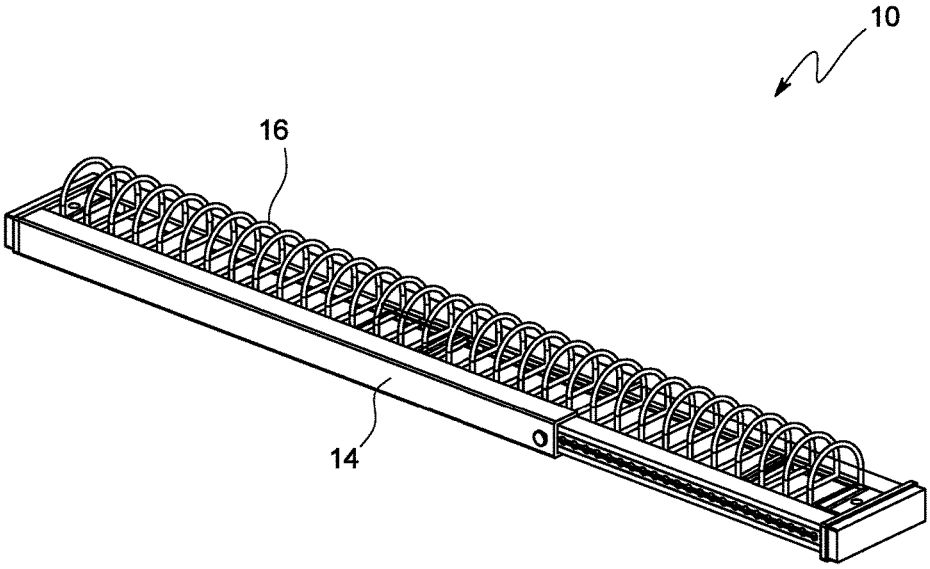
FIG. 5, according to an embodiment of the present invention, is an illustration of a perspective view of the tool holder in the distal lock position.
Figure 6:
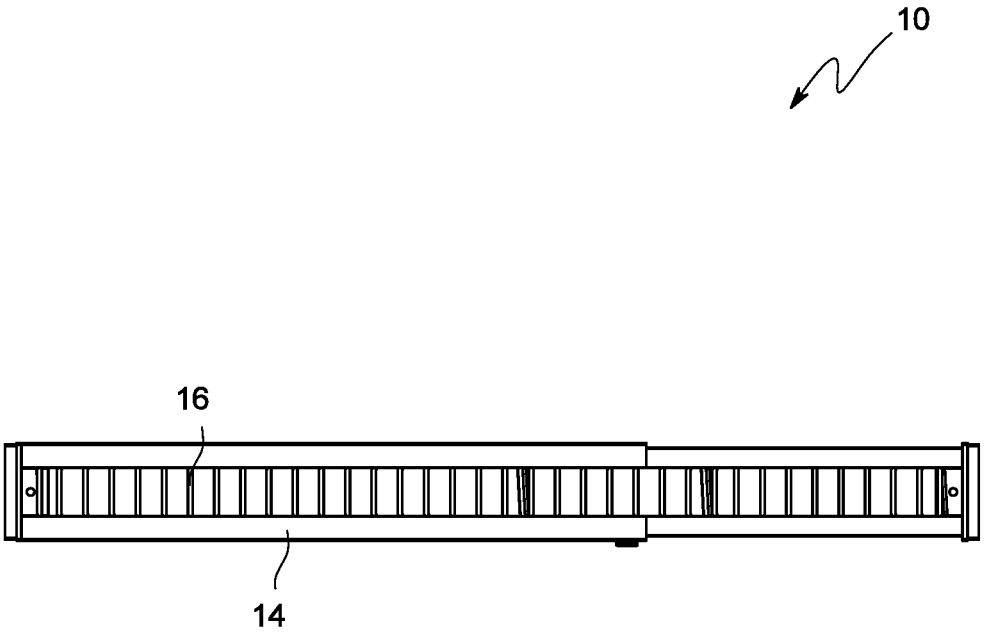
FIG. 6, according to an embodiment of the present invention, is an illustration of the top view of the tool holder in the distal lock position.
Figure 7:
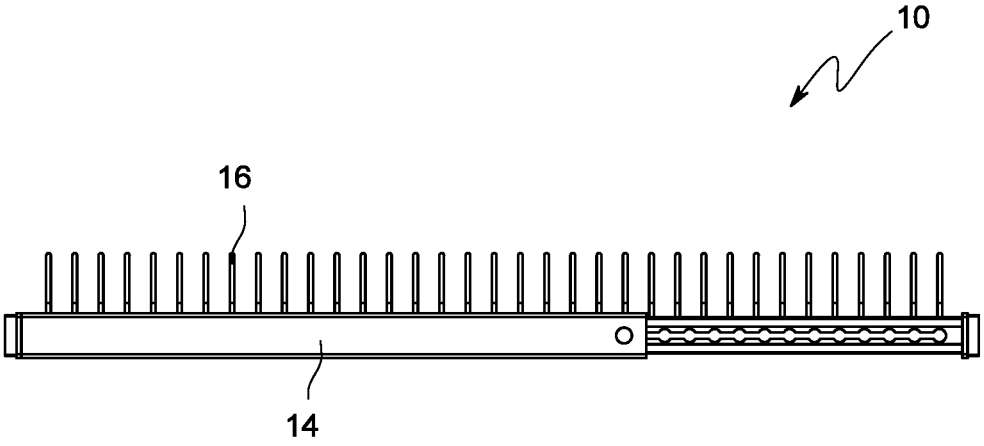
FIG. 7, according to an embodiment of the present invention, is an illustration of a side view of the tool holder in the distal lock position.

10—Adjustable Tool Holder
12—Hand Tool
14—Base Member
16—Compression Spring
18—Inner Member
20—Outer Member
22—First Central Panel
24—Side Rod
26—Support Track
28—Distal Panel
30—Longitudinal Guide
32—Distal Lock Hole
34—Proximal Lock Hole
36—Intermediate Lock Hole
38—End Cap
40—Second Central Panel
42—Rectangular Housing
44—Outer Lock Hole
46—Spring Support Member
48—Central Member
50—Slit
52—Side Member
54—Lock Pin
56—Elongate Portion of the Loop
58—Loop of the Spring

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Referring to FIGS. 1 through 8, the present invention comprises an adjustable tool holder 10 for holding a plurality of elongate hand tools 12. The tool holder 10, which is simple in construction, basically comprises a telescopically-adjustable base member 14 and a compression spring 16 secured to the base member 14 wherein, the length of the spring 16 is automatically altered as the length of the base member 14 is manually adjusted. As can be appreciated from FIG. 1, a tool 12 is secured to the tool holder 10 as the tool 12 is received between two consecutive loops of the spring 16.

Figure 20:
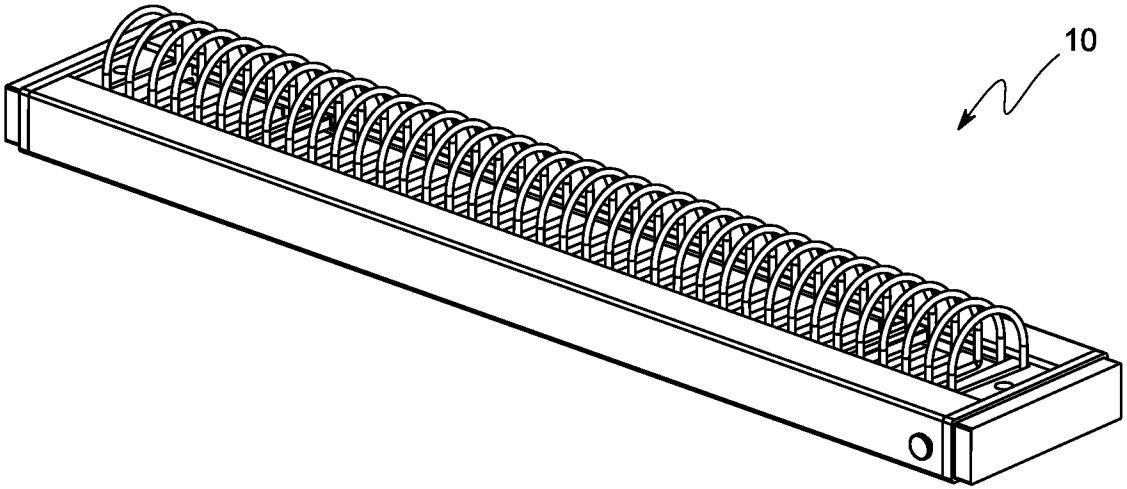
FIGS. 20 through 22, according to an embodiment of the present invention, are sequential illustrations of the tool holder in various sequential lock positions.
Figure 21:
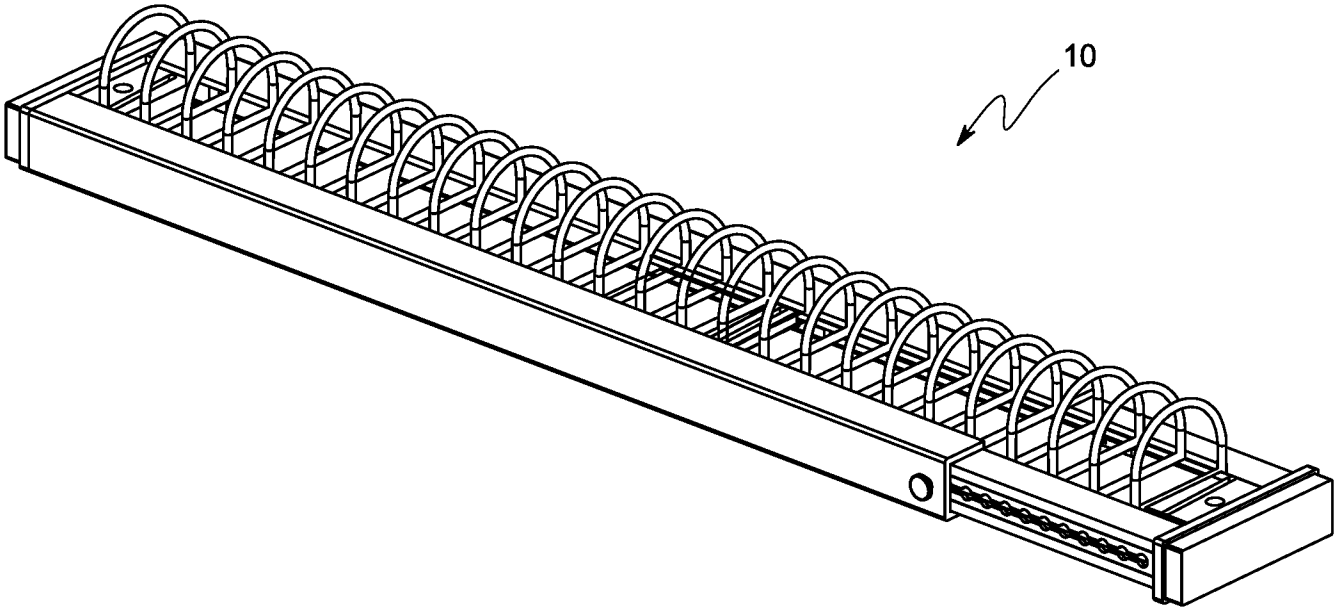
Figure 22:
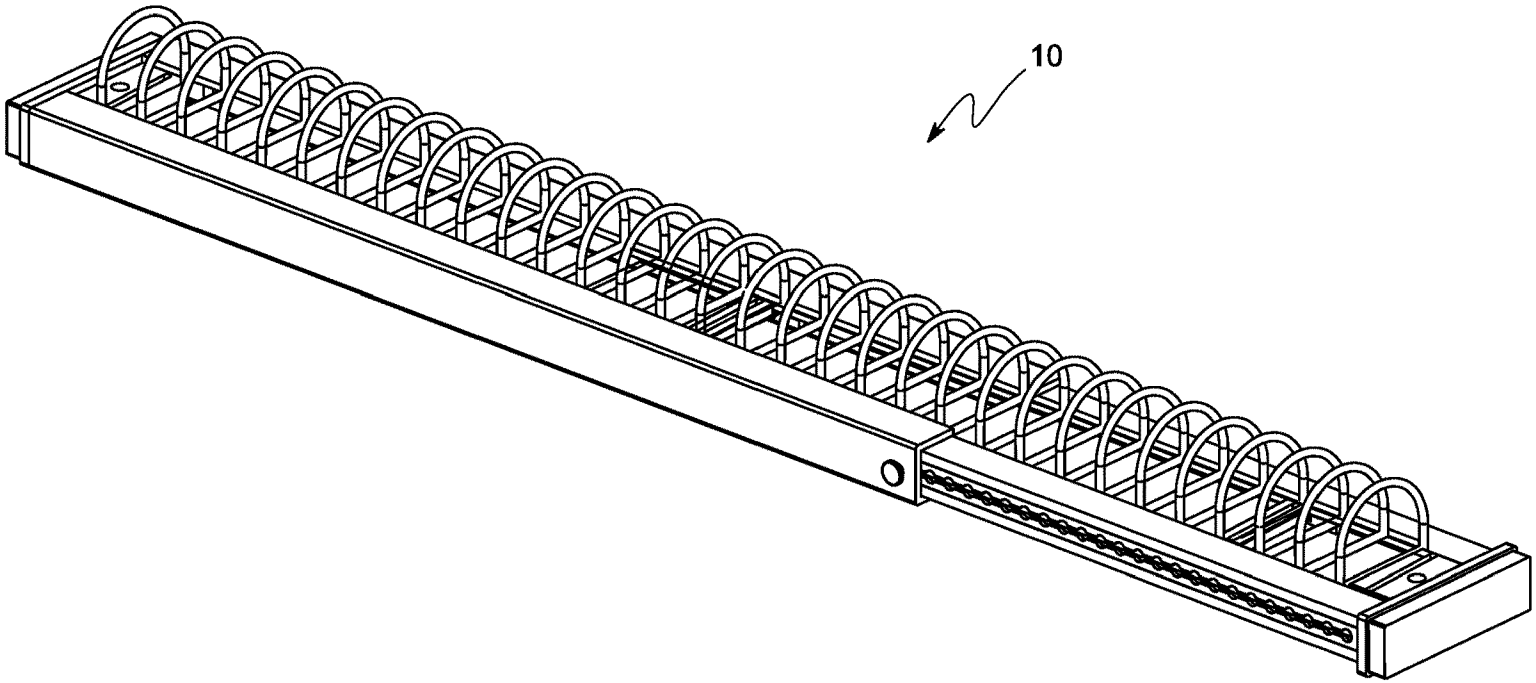

Referring to FIGS. 8 through 16, the base member 14 comprises an elongate, rectangular inner member 18 and an elongate, hollow, rectangular outer member 20 wherein, the inner member 18 is configured to be snugly and slidably received within the outer member 20. The inner member 18, by virtue of a pair of lock assemblies, which will be apparent from the following body of text, is adapted to be locked at a plurality of lock positions within the outer member 20 so as to render the length of the base member 14 adjustable. The plurality of lock positions comprises a proximal lock position (FIG. 20), a distal lock position (FIG. 22), and a plurality of intermediate lock positions (FIG. 21) disposed between the proximal and distal lock positions. Notably, the length of the base member 14 is shortest (substantially equivalent to that of the outer member 20) in the proximal lock position (FIG. 20) and longest in the distal lock position (FIG. 22).

Referring to FIGS. 9 through 13, the inner member 18 comprises an elongate, rectangular, first central panel 22 and a pair of elongate, hollow side rods 24 that integrally abut the longitudinal edges of the first central panel 22. Notably, the length of the first central panel 22 is equivalent that of each of the side rods 24. Each side rod 24 comprises a hollow structure of uniform rectangular cross-section wherein, as a result, the side rod is defined by a pair of elongate, opposingly-disposed top and bottom panels and a pair of elongate, opposingly-disposed proximal and distal panels. Each longitudinal edge of the first central panel 22 perpendicularly abuts the outer surface of the proximal panel such that, the longitudinal edge longitudinally bisects the outer surface of the proximal panel. The top panels extends inwardly beyond the top edge of the proximal panel so as to form a pair of opposingly-disposed elongate support tracks 26, the utility of which will become apparent from the following body of text.

Figure 9:
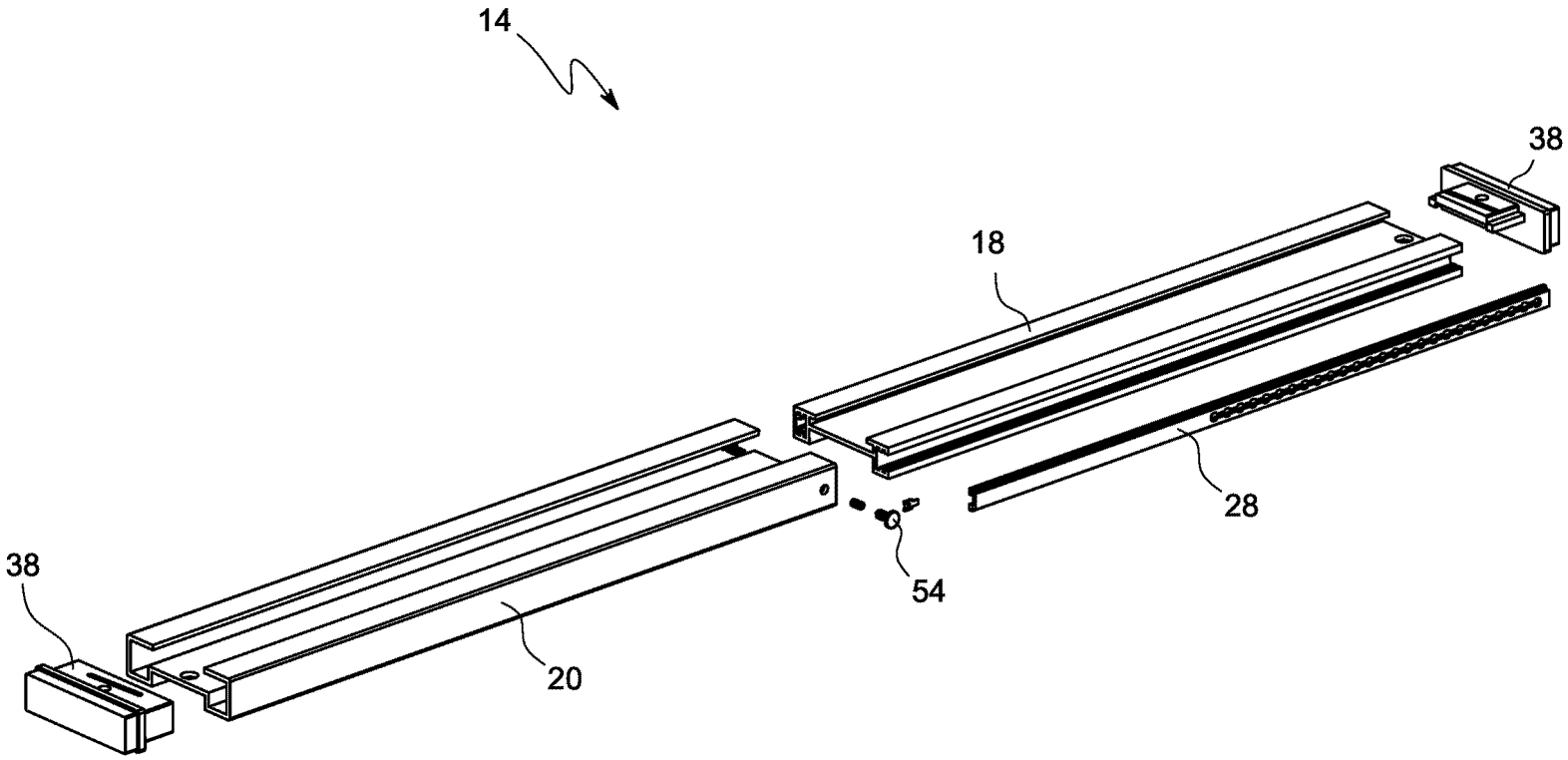
FIG. 9, according to an embodiment of the present invention, is an illustration of an exploded perspective view of the base member.
Figure 10:
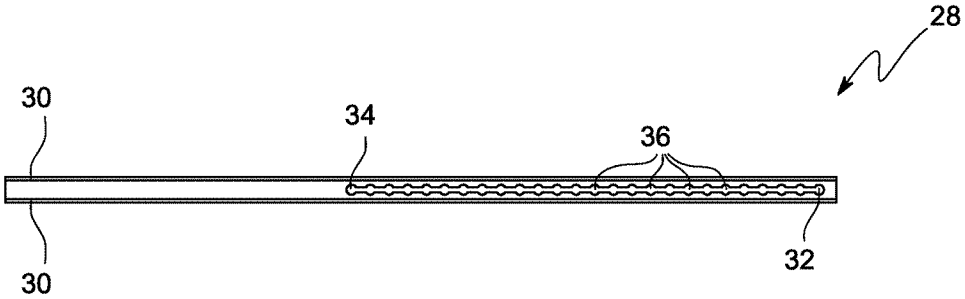
FIG. 10, according to an embodiment of the present invention, is an illustration of a top view of the distal panel.
Figure 11:
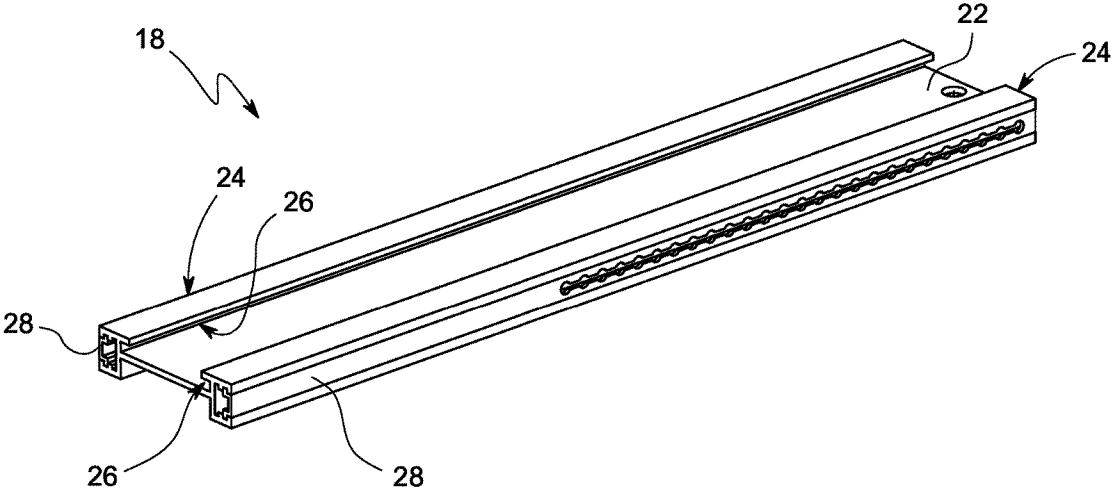
FIG. 11, according to an embodiment of the present invention, is an illustration of a perspective view of the inner member.
Figure 12:
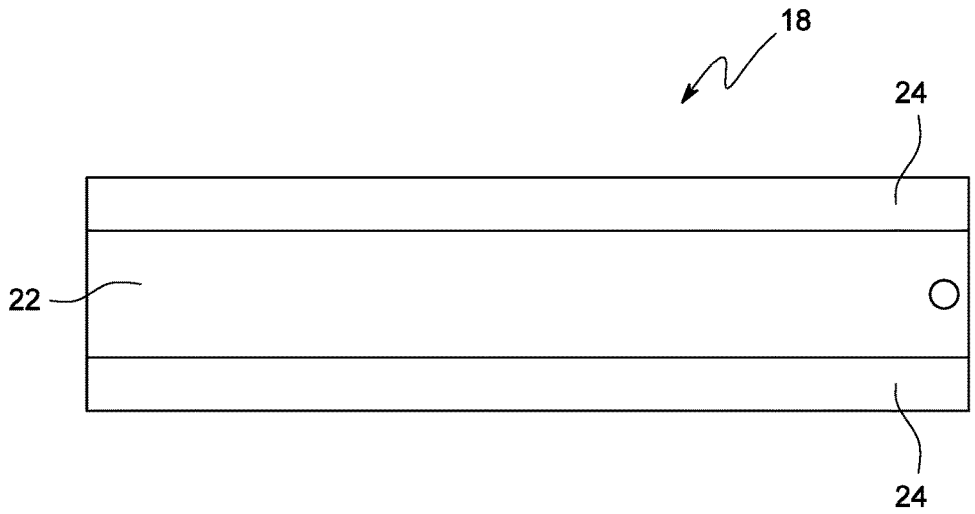
FIG. 12, according to an embodiment of the present invention, is an illustration of the top view of the inner member.
Figure 13:
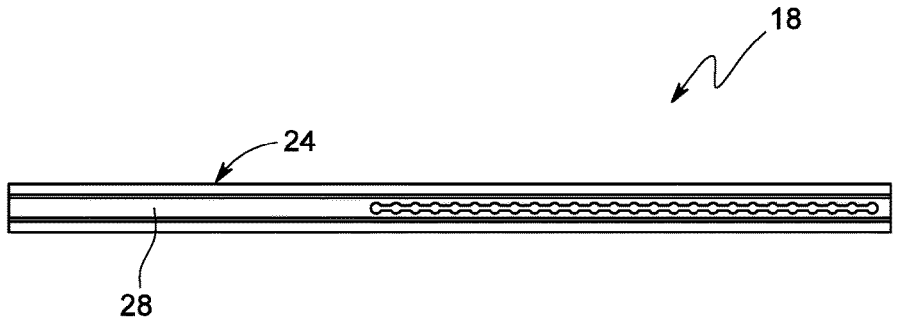
FIG. 13, according to an embodiment of the present invention, is an illustration of a side view of the inner member.

Referring to FIGS. 9 and 10, the lower and upper surfaces of the top and bottom panels respectively comprise a pair of elongate, opposingly-disposed top and bottom tracks, the utility of which will become apparent from the following body of text. As can be appreciated from FIG. 9, the distal panel 28 is removable and comprises a pair of elongate longitudinal guides 30, each of which extending from integrally from a longitudinal edge thereof. The longitudinal guides 30 are adapted to be slidably received within the top and bottom tracks until the lateral sides of the distal panel 28 become flush with those of the top and bottom panels. A plurality of linearly arranged inner lock holes proceed from one end of the distal panel 28 till a predetermined point wherein, the extremity inner lock hole at the extremity of the distal panel will hereinafter be referred to as the distal lock hole 32 and the other extremity inner lock hole will hereinafter be referred to as the proximal lock hole 34, while the rest of the inner lock holes will hereinafter be referred to as the intermediate lock holes 36. The free end of the inner member 18 is removably fitted with an end cap 38, which comprises a narrow slit, the utility of which will become apparent from the following body of text.

Figure 14:
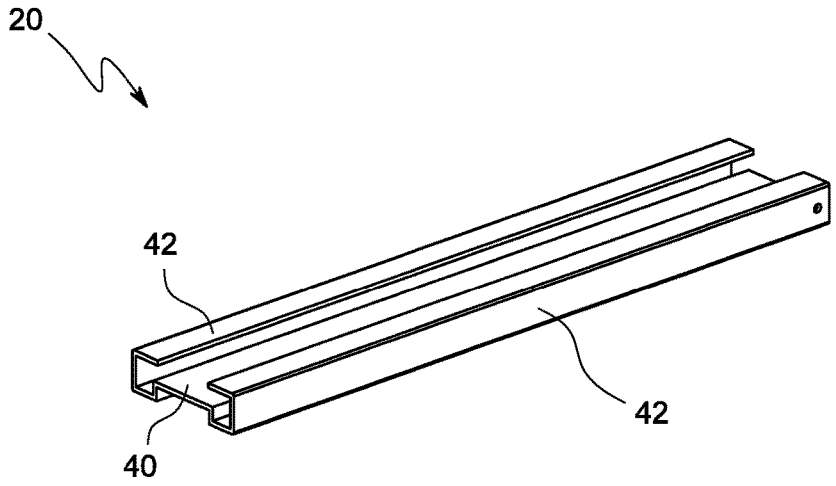
FIG. 14, according to an embodiment of the present invention, is an illustration of a perspective view of the outer member.
Figure 15:
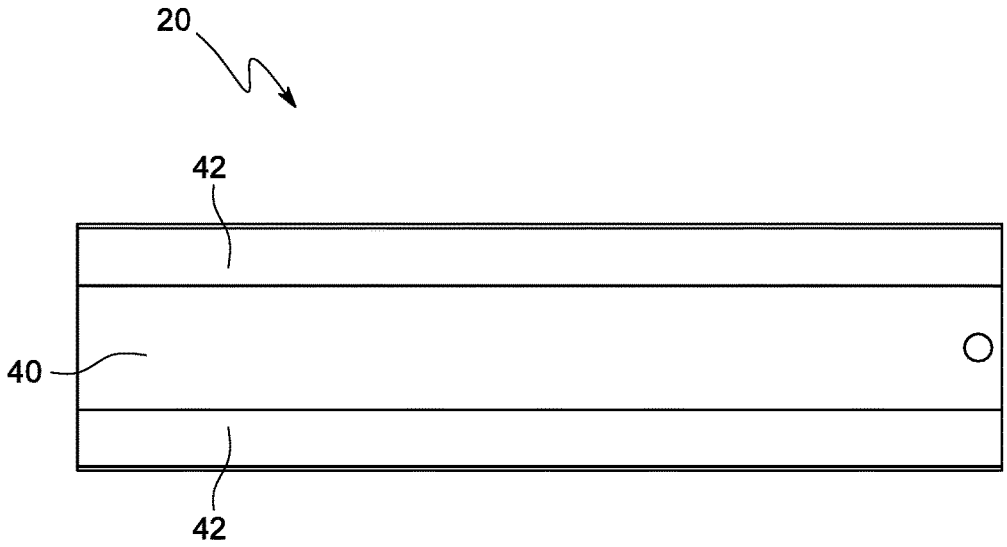
FIG. 15, according to an embodiment of the present invention, is an illustration of the top view of the outer member.
Figure 16:
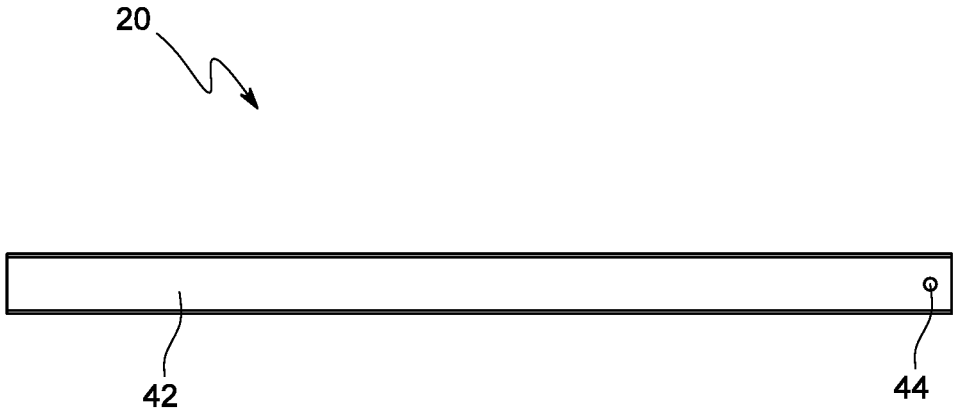
FIG. 16, according to an embodiment of the present invention, is an illustration of a side view of the outer member.

Referring to FIGS. 14-16, the outer member 20, which is structurally similar to the inner member 18, comprises an elongate, rectangular, second central panel 40 and a pair of elongate, opposingly disposed, rectangular housings 42 wherein, each rectangular housing 42 integrally extends from a longitudinal edge of the second central panel 40. Each side of the outer member comprises a through outer lock hole 44 closer to one extremity thereof wherein, the utility of the outer lock hole 44 will become apparent from the following body of text. The free end of the outer member 20 is removably fitted with an end cap 38, which comprises a narrow slit, the utility of which will become apparent from the following body of text.

Figure 8:
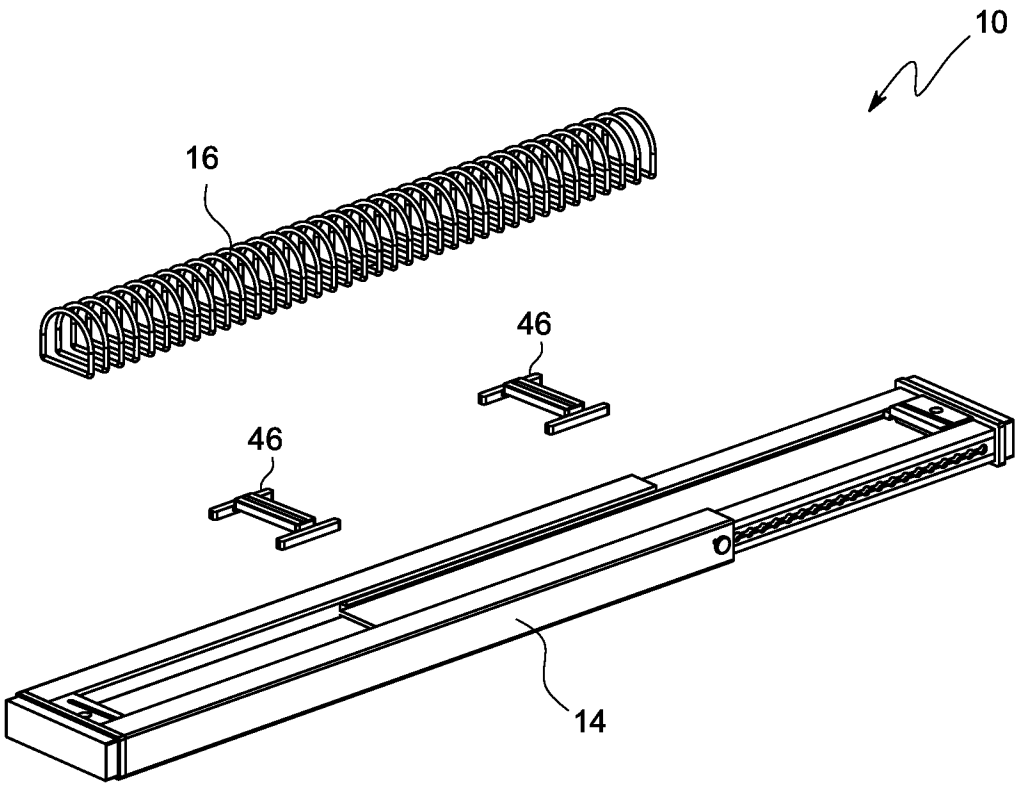
FIG. 8, according to an embodiment of the present invention, is an illustration of an exploded perspective view of the tool holder.
Figure 17:
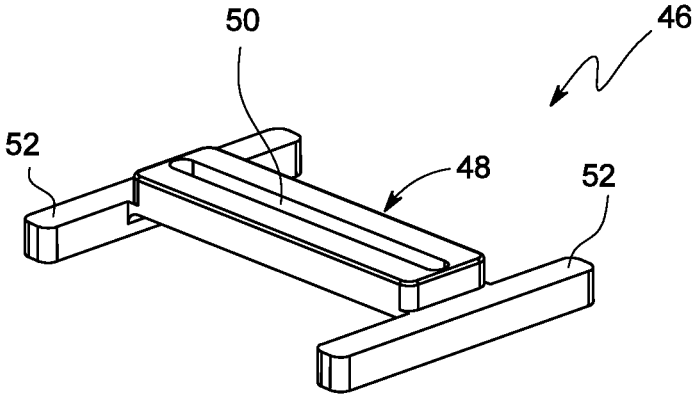
FIG. 17, according to an embodiment of the present invention, is an illustration of a perspective view of the spring support member.
Figure 18:
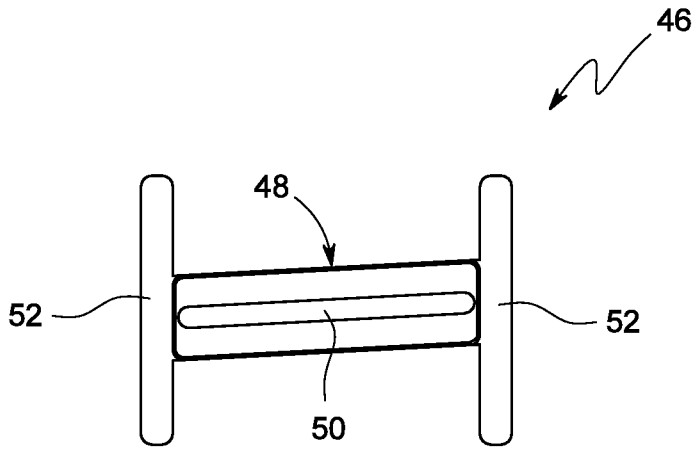
FIG. 18, according to an embodiment of the present invention, is an illustration of the top view of the spring support member.
Figure 19:
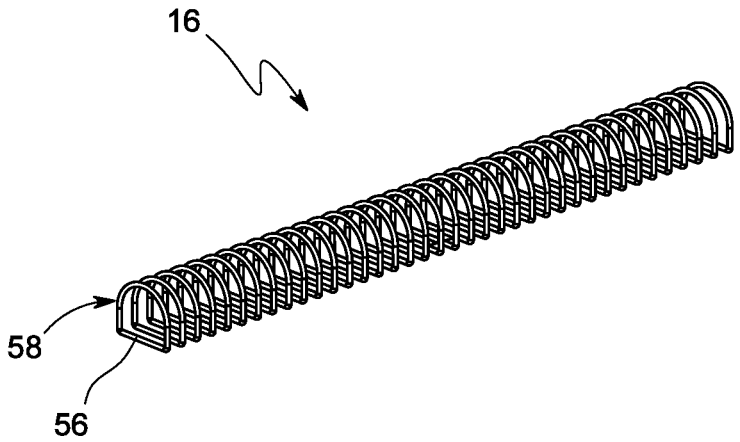
FIG. 19, according to an embodiment of the present invention, is an illustration of a perspective view of the D-shaped compression spring.

Referring to FIGS. 8, 17 and 18, the tool holder 10 further comprises a pair of spring support members 46, each of which comprising an elongate central member 48 comprising a narrow slit 50 centrally disposed thereon along the longitudinal axis thereof wherein, the utility of the slit 50 will become apparent from the following body of text. Notably, the bottom surface of central member 48 is planar. The support member 46 further comprises a pair of elongate, opposingly-disposed side members 52, each of which abutting an extremity of the central member 48 such that, the central member 48 and the side members 52 are at right angles with respect to each other. The bottom surfaces of the side members 52 are planar so as to serve a utility, which will become apparent from the following body of text. Notably, the bottom surfaces of the central 48 and the side members 52 are flush with respect to one another. The support members 46 are configured to slide over the top surface of the first central panel 22 (of the inner member 18) as the side members 52 are snugly received within the aforementioned opposingly-disposed support tracks 26. In other words, the side members 52 act as guides within the support tracks 26.

As the inner member 18 is slid into the outer member 20, the side rods 24 are snugly received within the rectangular housings 42, while the first and second central panels 22 and 40 abut one another. More particularly, the first central panel 22 slides atop the second central panel 40 as the inner member 18 is received within the outer member 20. As the sliding of the inner member 18 progresses within the outer member 20, the outer lock hole 44 aligns with the inner lock holes sequentially beginning from the proximal lock hole 34 and ending with the distal lock hole 32. When a lock pin 54 is inserted into an inner lock hole via the outer lock hole 44, the position of base member 14 is locked thereat and such a position is referred to as a lock position. If the aligned lock holes comprise the outer lock hole 44 and the proximal lock hole 34, then the resulting locked position is referred to as the aforementioned proximal lock position. In a similar manner, if the aligned lock holes comprise the outer lock hole 44 and the distal lock hole 32, then the resulting locked position is referred to as the aforementioned distal lock position. Notably, the lock pin 54 and the outer and inner lock holes are collectively referred to as the aforementioned lock assembly.

Referring to FIGS. 1 through 8 and 19 through 22, the spring 16 is substantially D-shaped wherein, the spring 16 is secured to the base member 14 as the elongate portions 56 of the loops 58 of the spring 16 are secured within the narrow slits of the end caps 38 and the support members 46. Alternatively, the spring 16 may of any shape, such as, circular, rectangular, etc., as long as the functionality thereof is not hampered. Therefore, as can be appreciated from FIGS. 20 through 22, as the base members 14 is transitioned between various lock positions so as to suit the tools, the length of the spring 16 is automatically altered accordingly.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. For example, the protective case assembly can be adapted to accommodate a tablet PC by simply altering the dimensions thereof. However, all such modifications are deemed to be within the scope of the claims.

It is claimed:

1. An adjustable tool holder comprising:

(a) a telescopically adjustable base member comprising:
  (i) an elongate, rectangular, hollow outer member; and
  (ii) an elongate rectangular inner member configured to be slidably received within the outer member, the inner member adapted to be secured to the outer member at a plurality of lock positions, thereby rendering the length of the base member adjustable;

(b) a compression spring having one end secured at a free end of the outer member and the other end secured at a free end of the inner member;

whereby the length of compression spring is subject to change in accordance with the change in the length of the base member;

consecutive loops of the compression spring adapted to hold a handheld tool therebetween;

the inner member comprising at least one spring support member secured thereto such that the spring support member is adapted to slide along the length thereof;

the spring support member comprising a narrow slit that serves as a receptacle for receiving a portion of the loop of the spring therewithin so as to support to the spring;

the spring support member comprising:

(a) an elongate central member having the narrow slit; and (b) a pair of opposingly-disposed side members, each of which is secured to an extremity of the central member such that the central member bisects the pair of side members, each of the side members comprising a planar bottom surface about which the spring support member slides over the surface of the inner member, each side member adapted to be slidably received within an elongate track disposed along the length of the inner member, the pair of tracks supporting the sliding movement of the spring support member, the pair of tracks being a part of the inner member, and the pair of tracks being perpendicular to the central member.

2. An adjustable tool holder comprising:

(a) a telescopically adjustable base member comprising:
  (i) an elongate, rectangular, hollow outer member; and
  (ii) an elongate rectangular inner member configured to be slidably received within the outer member, the inner member adapted to be secured to the outer member at a plurality of lock positions, thereby rendering the length of the base member adjustable;

(b) a compression spring having one end secured at a free end of the outer member and the other end secured at a free end of the inner member;

whereby the length of compression spring is subject to change in accordance with the change in the length of the base member;

consecutive loops of the compression spring adapted to hold a handheld tool therebetween; and at least one locking assembly for securing the base member at each lock position, each of the at least one the locking assembly comprising an outer lock hole disposed on the outer member and a plurality of inner lock holes disposed on the inner member in a linear layout wherein, as the inner member is slid though the outer member, at each lock position the at least one outer lock hole aligns with an inner lock hole, at which point inserting a lock pin through the aligned lock holes secures the base member in the lock position.

3. The tool holder of claim 2 wherein, the cross-sectional shape of the spring comprises a uniform substantially D-shape; the spring held by the base member about non-curved portions of the loops of the spring.

4. The tool holder of claim 2 wherein, the base member further comprises a pair of end caps; one end cap secured to the free end of the outer member while the other end cap is secured to the free end of the inner member; each of the end caps comprising a narrow slit that serves as a receptacle for snugly receiving a portion of the loop of the spring therewithin so as to secure the spring to the base member.

5. The tool holder of claim 2 wherein the inner member comprises at least one spring support member secured thereto such that the support member is adapted to slide along the length thereof; the support member comprising a narrow slit that serves as a receptacle for receiving a portion of the loop of the spring therewithin so as to support to the spring.

6. The tool holder of claim 2 wherein the inner member comprises:

(a) an elongate central panel; and (b) a pair of elongate, opposingly-disposed, side rods, a surface of each side rod attached to a longitudinal edge of the central panel.

7. The tool holder of claim 6 wherein the outer member comprises:

(a) an elongate central panel which abuts the central panel of the inner member as the inner member is slidaby received within the outer member; and (b) a pair of elongate, opposingly-disposed housings extending from longitudinal edges of the central panel, each housing for slidably receiving a side rod therewithin.

8. The tool holder of claim 2 wherein, the at least one locking assembly comprises a pair of locking assemblies disposed on either side of the base member.

9. An adjustable tool holder comprising:

(a) a telescopically adjustable base member comprising:

(i) an elongate, rectangular, hollow outer member; and (ii) an elongate rectangular inner member configured to be slidably received within the outer member, the inner member adapted to be secured to the outer member at a plurality of lock positions thereby rendering the length of the base member adjustable, the inner member being substantially of the same length as the outer member;

(b) a compression spring, one end of which is secured at a free end of the outer member and the other end of which is secured at a free end of the inner member; and (c) at least one lock assembly for securing the base member at each lock position, each of the at least one locking assembly comprising:

(i) a lock pin;

(ii) a top lock hole disposed on the outer member; and (iii) a plurality of bottom lock holes disposed on the inner member in a linear layout wherein, as the inner member is slid though the outer member, at each lock position, the top lock hole aligns with a bottom lock hole, at which point, inserting the lock pin through the aligned lock holes secures the base member at the lock position t;

the length of the spring being subject to change in accordance with the change in the length of the base member; and a tool adapted to be held between two consecutive loops of the compression spring.

* * * * *